United States Patent [19]

Fox et al.

[11] 4,343,269

[45] Aug. 10, 1982

[54] IGNITION DISTRIBUTOR ROTOR ALIGNMENT AND LOCK-DOWN ASSEMBLY

[75] Inventors: David H. Fox, Ann Arbor; Charles C. Kostan, Canton, both of Mich.

[73] Assignee: Ford Motor Company, Dearborn, Mich.

[21] Appl. No.: 103,673

[22] Filed: Dec. 14, 1979

[51] Int. Cl.[3] ..... F02P 7/02

[52] U.S. Cl. ..... 123/146.5 A; 200/19 R; 200/19 DR

[58] Field of Search ..... 123/146.5 A; 200/19 R, 200/19 DR

[56] References Cited

U.S. PATENT DOCUMENTS

| | | | |
|---|---|---|---|
| 1,939,807 | 12/1933 | Fibish | 200/19 DR |
| 3,124,666 | 3/1964 | O'Brien | 200/19 DR |
| 3,450,848 | 6/1969 | Prins | 200/22 |
| 3,646,922 | 3/1972 | Spalding | 123/146.5 A |
| 4,023,546 | 5/1977 | Kawakami | 123/146.5 A |
| 4,153,030 | 5/1979 | Power et al. | 123/146.5 A |

*Primary Examiner*—Charles J. Myhre
*Assistant Examiner*—Andrew M. Dolinar
*Attorney, Agent, or Firm*—Paul K. Godwin, Jr.; Clifford L. Sadler

[57] ABSTRACT

A lock-down assembly for a commutation rotor in a fixed mount high voltage ignition distributor. The assembly allows for angular adjustment of the rotor about its axis prior to lock-down in proper position with respect to a predetermined point on the fixedly mounted base and the corresponding timing position of the engine.

13 Claims, 10 Drawing Figures

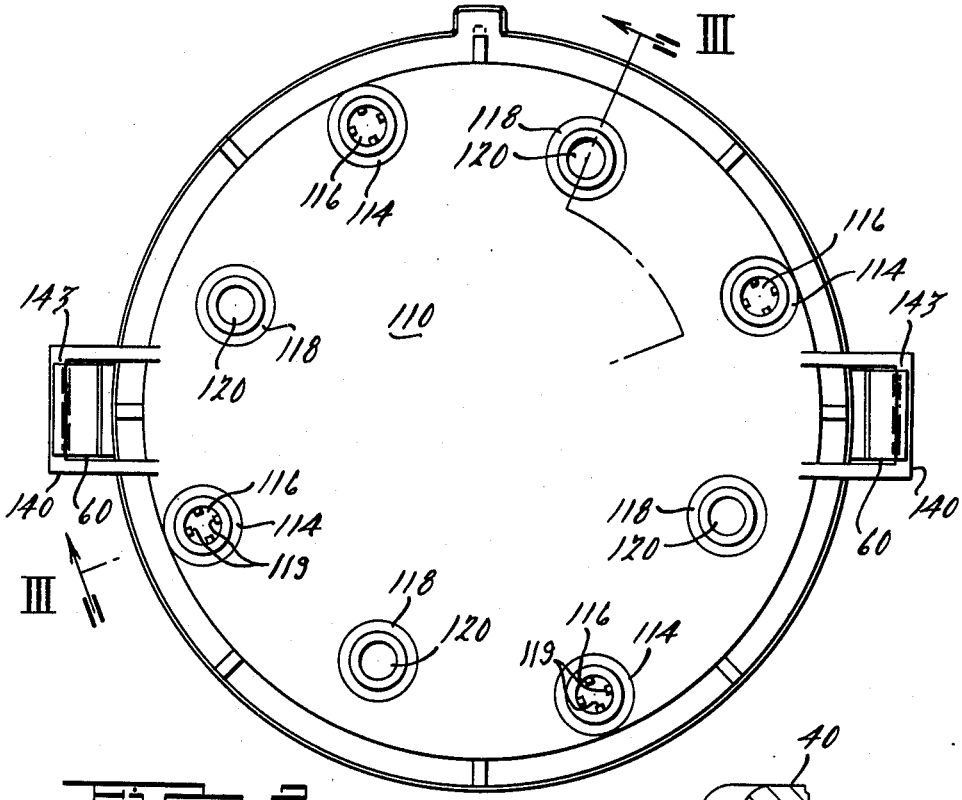
FIG. 2.
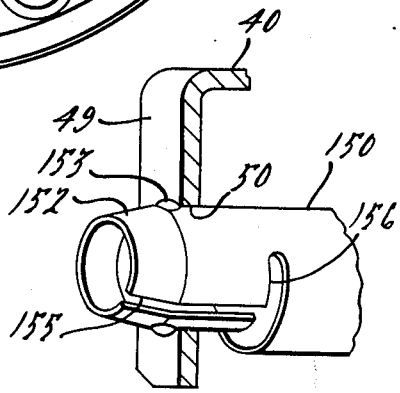
FIG. 5.
FIG. 4.
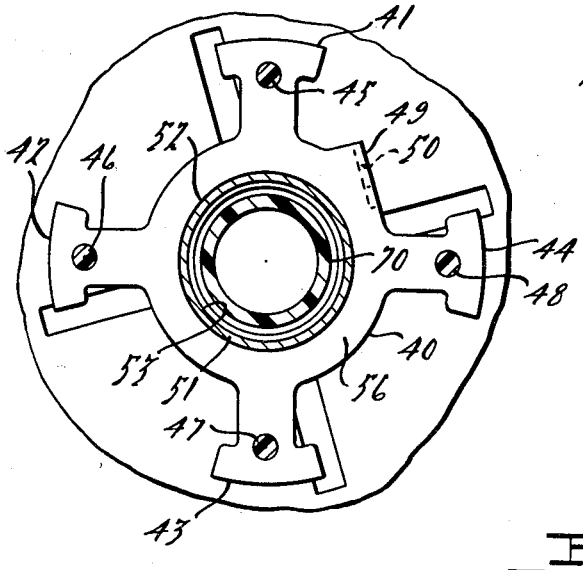
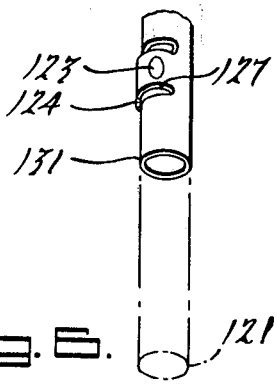
FIG. 6.

IGNITION DISTRIBUTOR ROTOR ALIGNMENT AND LOCK-DOWN ASSEMBLY

CROSS-REFERENCE TO RELATED APPLICATIONS

The subject matter disclosed herein is related to contemporaneously filed U.S. patent applications designated by Ser. No. 103,679 now U.S. Pat. No. 4,285,306; Ser. Nos. 103,680; 103,678; 103,677 now U.S. Pat. No. 4,282,836; Ser. Nos. 103,674; 103,675 now U.S. Pat. No. 4,295,014; Ser. Nos. 103,676; 103,672; 103,634 now U.S. Pat. No. 4,293,744; and Ser. No. 103,632.

BACKGROUND OF THE INVENTION

1. Field of the Invention

The present invention is directed to the field of high voltage commutation distributors for use within internal combustion engines and more specifically to a unique rotor alignment and lock-down assembly.

2. Description of the Prior Art

Electrical commutators, for internal comubstion engines are commonly called distributors and normally include a base attached to the engine, a cap and a shaft. The shaft is gear driven by the engine to rotate in synchronization with the engine. The shaft is normally mounted in the base with a bearing or bushing to provide low frictional rotation about a central axis of the base. A rotor element is attached to the shaft inside a commutation cavity defined by the distributor base and cap. The distributor cap is formed to mount on the base and contains several electrical contacts that are insulated from each other and connected to individual spark plugs of the engine. The rotor element may contain one or more commutation electrodes that provide electrical connection between a common high voltage source electrode and individual ones of the spark plug contacts on the cap.

Initially, it is necessary that the rotor element be aligned so that, when a particular piston of the engine is at top dead center (TDC), the rotor electrode will be registered with the spark plug electrode associated with that particular piston at a predetermined angular position to accomodate the ignition timing strategy of the particular engine.

In the prior art, several assemblies have been made whereby the rotor is secured to the gear driven rotor driveshaft.

U.S. Pat. Nos. 3,450,848; 3,646,922; 4,023,546 and 4,153,030 illustrate the typical prior art attachment of the rotor commutation element to the rotor driveshaft. Those techniques include keys and keyways, whereby the rotor is connected to the driveshaft at a fixed position with respect thereto. In each case, the distributor base is mounted on the engine so as to be rotatable with respect thereto. Therefore, alignment of the rotor commutation electrode with a particular spark plug terminal is achieved by rotating the base about the rotor driveshaft and rotor element until proper registration is achieved. Then, the base is tightened to the engine in an attempt to maintain the relative positions of the rotor commutation element in its registration relationship with the particular spark plug terminals.

In each of the prior art distributors mentioned above, engine vibrations eventually may cause the distributor base to rotate slightly from its initial setting and thereby effect timing of the engine.

SUMMARY OF THE INVENTION

The present invention is ideally suited for use with distributors of the type disclosed in copending U.S. Patent Application Ser. No. 103,679, entitled *DISTRIBUTOR ENGINE MOUNTING MECHANISM,* noted above, wherein the base of the distributor is non-adjustably mounted to the engine in a predetermined position. In such a distributor, it is necessary to be able to align the commutation rotor electrode so that it is in proper registration alignment to achieve proper ignition sequence of the spark plug terminals.

In the described embodiment, the rotor driveshaft element contains a lower socket portion having an hexagonal cross-section for mating with and engaging the hexagonal shaft portion extending from a drive gear. The upper portion of the rotor driveshaft contains a rotor mounting plate containing at least one threaded socket. A rotor commutation element mounts on the rotor mounting plate. The rotor element is substantially formed of a thermo-plastic material such as "RYNITE 530" and contains a pair of arcuate apertures which extend from the top of the rotor to the bottom thereof to expose a portion of the rotor mounting plate. The arcuate sidewalls of the arcuate apertures are slightly tapered with respect to each other and one of those sidewalls contains equally spaced serrations over its length. Wedge-like locking elements are formed to be inserted into the arcuate apertures via a screw which is threaded into the socket on the rotor mounting plate. When the screw is tightened, the wedges are compressed against the sidewalls of the arcuate apertures, thereby holding the rotor element tightly against the rotor mounting plate and thereby preventing the rotor element from rotationally moving with respect to the central axis of rotation of the rotor driveshaft and preventing upward movement of the rotor with respect to the mounting plate.

In order to place the rotor commutation element in proper conducting registration with a selected spark plug terminal, as indicated on the base portion of the commutation cavity, the rotor driveshaft, with the rotor element loosely mounted thereon, is partially inserted into the fixed distributor base and is roughly rotationally oriented. Then the rotor driveshaft is mated with the hexagonal driveshaft at a position whereby the rotor commutation element is roughly aligned with a predetermined spark plug terminal. Thereafter, the rotor element is rotationally positioned on the then fixed rotor driveshaft until the rotor electrode is properly positioned. The lock-down wedges are then tightened via a lock-down screw so as to compress the rotor element against the rotor mounting plate.

The rotor lock-down wedges are constructed so as to frictionally ride on the upper shank of the lock-down screw so that the wedges are held out of engagement during adjustment and when the screw is turned clockwise and threaded to the socket on the rotor mounting plate, the lock-down wedge is pulled downward with respect to the rotor sidewalls and engaged in its locked position. Guide tabs extend upward from the rotor mounting plate adjacent the threaded sockets and prevent the wedge from rotating with the screw as it is moved from its locked position to its unlocked position and vice versa. Each lock-down wedge contains a pair of wing-like extensions which receive the tab therebetween and prevent the previously mentioned rotation.

It is an object of the present invention to provide a rotor alignment mechanism for use with distributors which are fixedly mounted to an associated internal combustion engine.

It is another object of the present invention to provide a unique rotor lock-down mechanism utilizing lightweight plastic materials.

It is a further object of the present invention to provide a unique rotor lock-down mechanism that is substantially immune to loosening by engine vibrations.

BRIEF DESCRIPTION OF THE DRAWINGS

FIG. 2 is a top plan view of the distributor cap shown in FIG. 1.

FIG. 4 is a plan view of the common high voltage electrode shown in FIG. 3.

FIG. 5 is a detailed view of the high voltage coil wire connector terminal shown in FIG. 3.

FIG. 6 is a detailed view of the spark plug wire connector terminals shown in FIG. 3.

DESCRIPTION OF THE PREFERRED EMBODIMENT

The present invention is embodied in a high voltage commutation distributor shown in the appended figures and intended for use on an internal combustion engine. This distributor is formed, for the most part, from lightweight high strength thermo-plastic materials; and is relatively inexpensive to manufacture, assemble and service. Although the distributor shown is configured for an 8 cylinder engine, it should be understood that the concepts taught in this discussion are equally applicable to distributors designed for any internal combustion engine.

Figure 1:
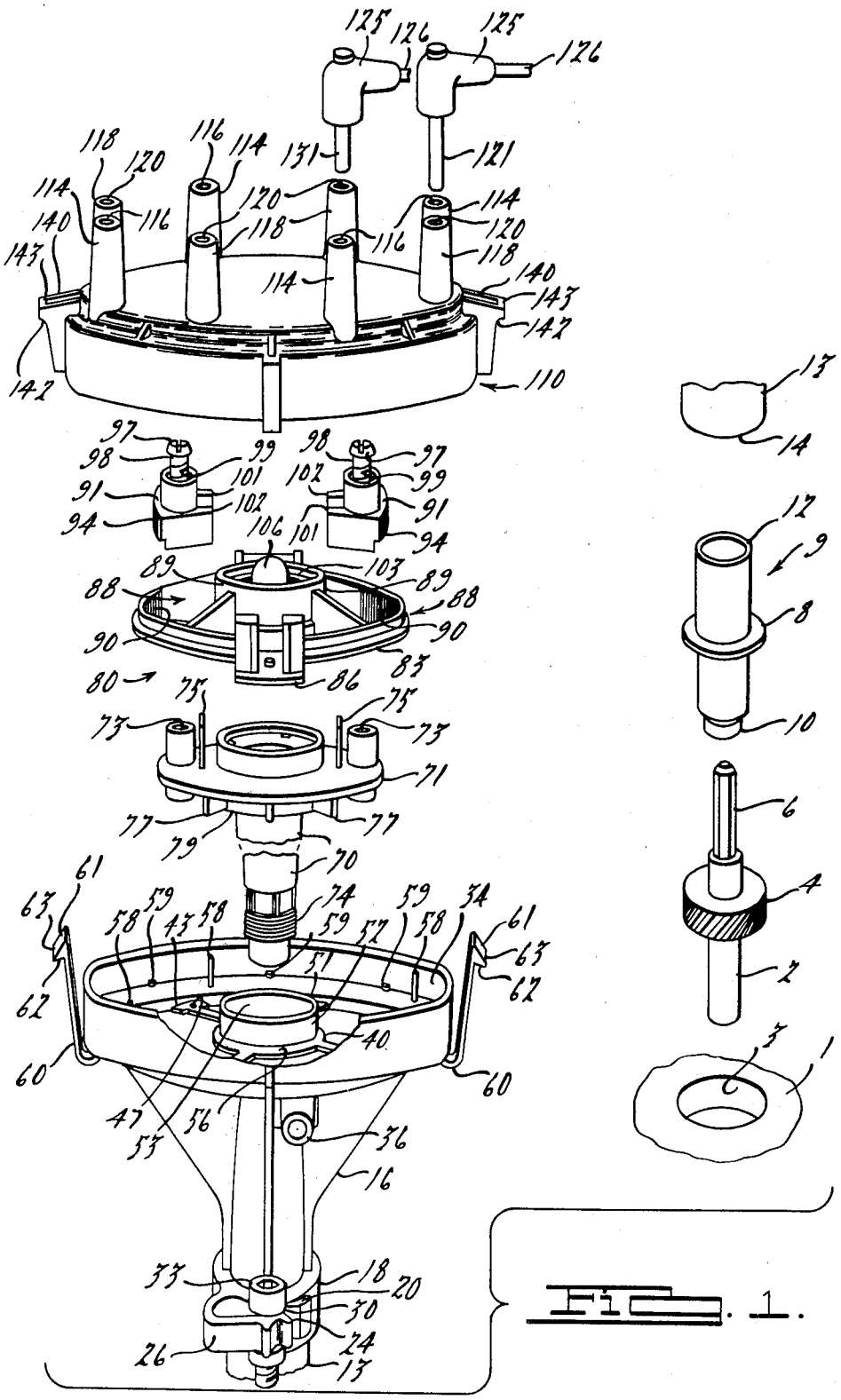
FIG. 1 is an exploded view of the overall distributor embodying the present invention.

The overall distributor is shown in an exploded assembly view in FIG. 1, while the pertinent details of parts shown in FIG. 1 are provided in the remaining figures.

For purposes of organization, the following description is ordered according to the assembly sequence of the distributor onto an internal combustion engine.

Figures 3, 9A, 9B:
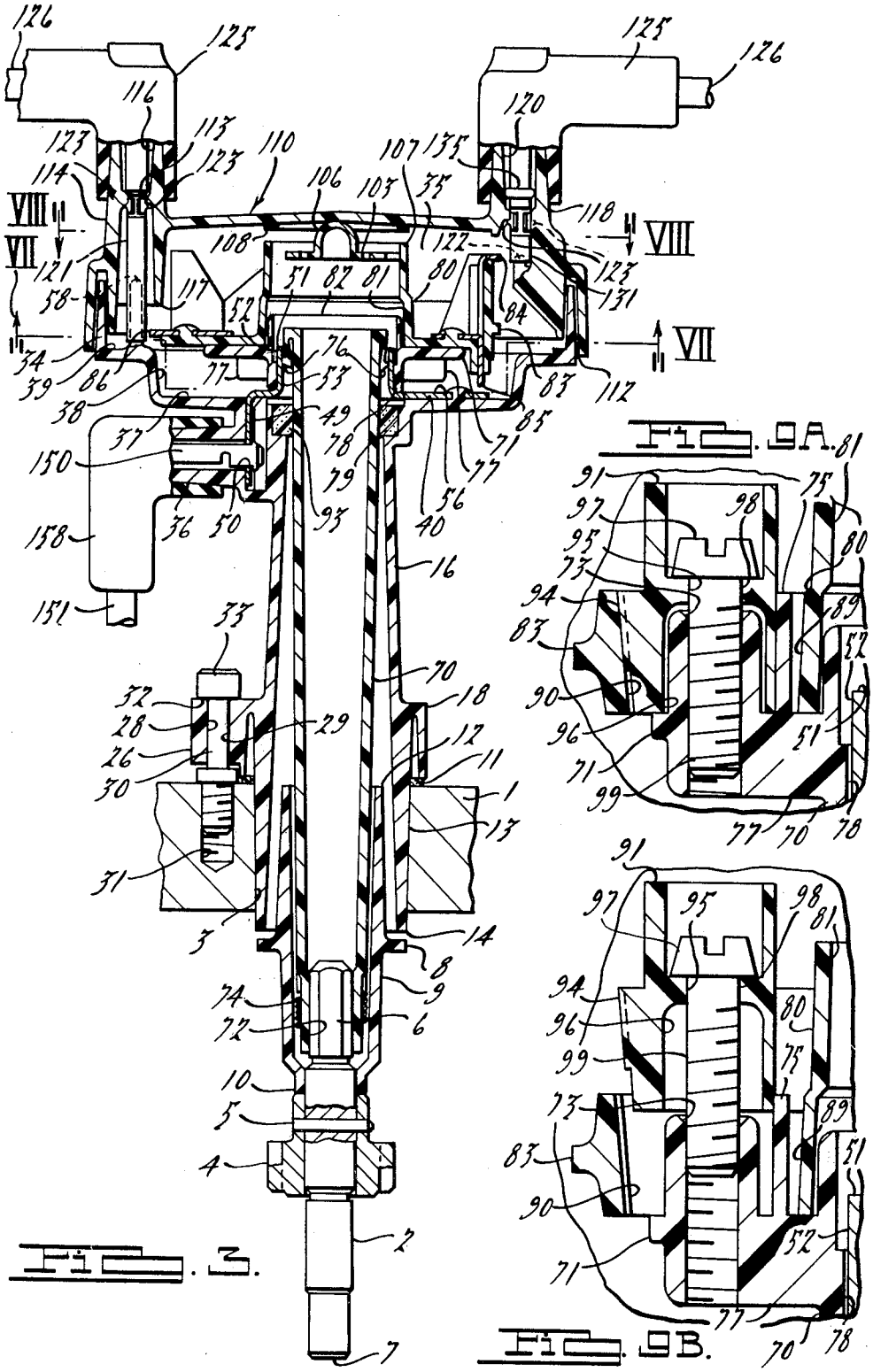
FIG. 3 is a cross-sectional view of the distributor taken along lines III—III indicated in FIGS. 2 and 8.
FIGS. 9*a* and 9*b* are cross-sectional views of the rotor locking and alignment mechanism in respective locked and unlocked positions.
Figure 7:
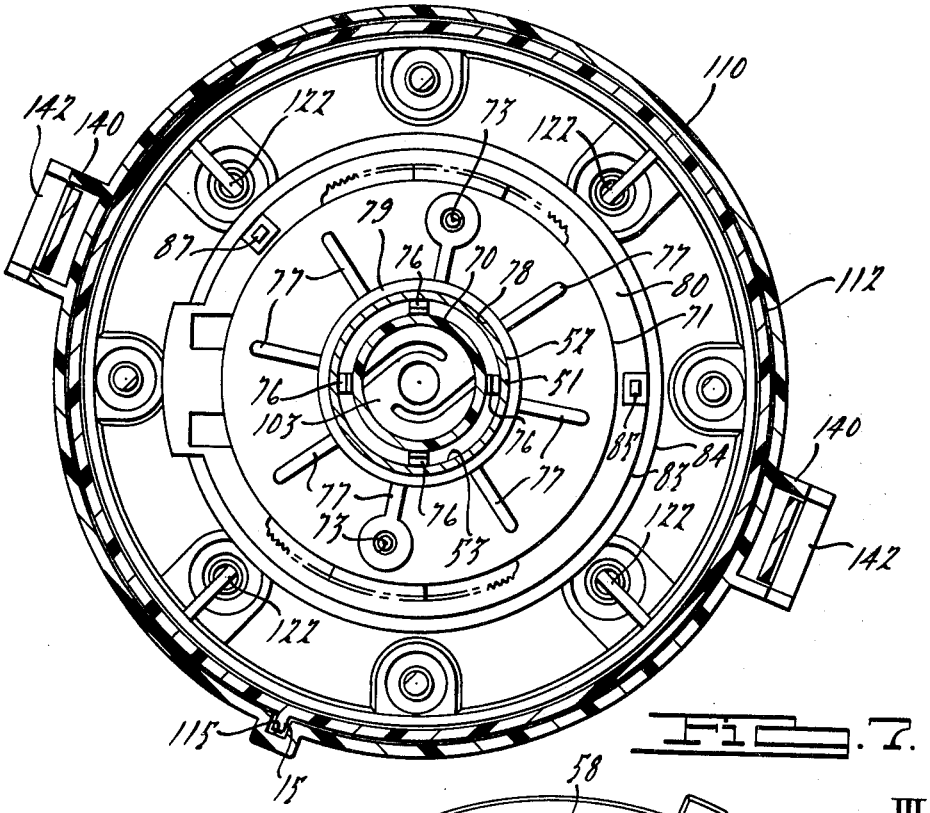
FIG. 7 is a cross-sectional view of the distributor taken along section lines VII—VII, indicated in FIG. 3.
Figure 8:
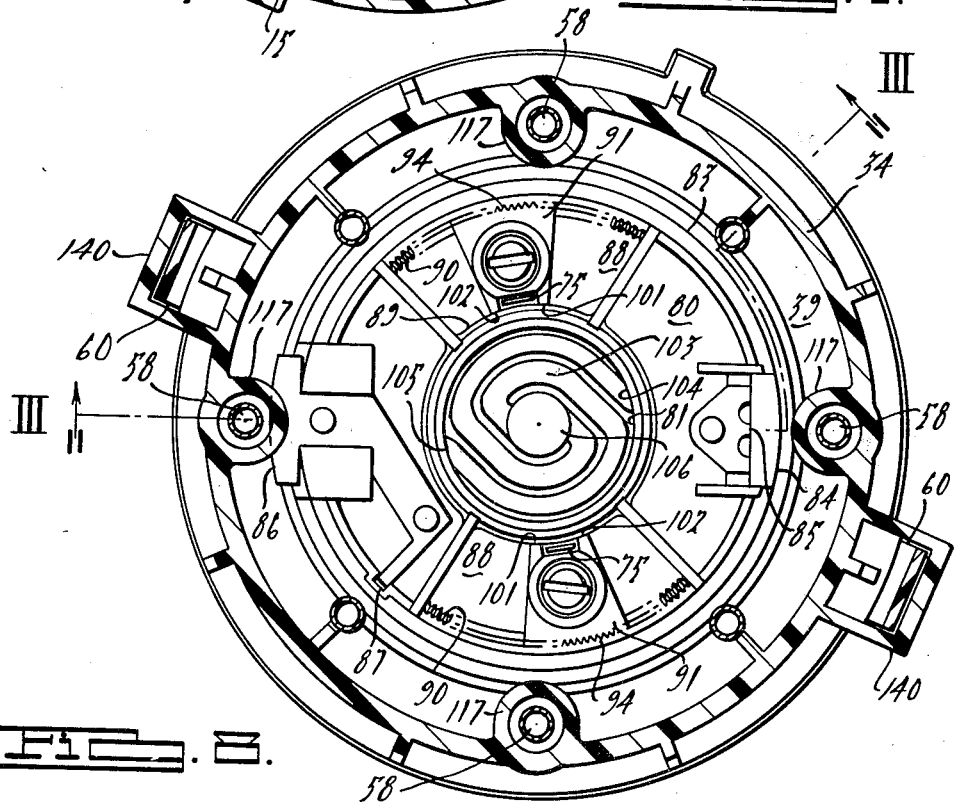
FIG. 8 is a cross-sectional view of the distributor taken along lines VIII—VIII, indicated in FIG. 3.

A helical drive gear 4, shown in FIGS. 1 and 3, is formed of nodular iron and permanently mounted onto an hexagonal cross-section driveshaft 6 with a lock pin 5. A socket piece 2 extends downward from the drive gear 4 and contains a hexagonal cross-section socket 7 for mating with an oil pump drive shaft (not shown). The gear 4 is placed into the engine 1, through a distributor mounting hole 3 so that the hexagonal shaft 6 stands outward towards the hole opening. The drive gear 4 mates with a conventional internal combustion engine gearing network (not shown) which provides a predetermined turns ratio to synchronize the turns of the gear 4 with the firing cycle speed of the engine. The crankshaft of the engine is the basis for controlling synchronization, since it rotates twice for every firing cycle. In this case the gear 4 is synchronously driven at half the speed of the crankshaft.

A spacer cup 9 is shown in FIGS. 1 and 3 and is freely mounted between the top of the gear 4 and the distributor base opening 14, which is described below. The spacer cup 9 has a relatively small opening 10 which extends downwardly away from a centrally located collar 8. The small opening 10 is larger than the hexagonal shaft 6 and smaller than the diameter of the gear 4. The upper end of the spacer cup 9 has a relatively large opening 12, sized sufficiently to fit within the distributor base opening 14 and surround a hollow plastic rotor driveshaft 70. The spacer cup 9 has a collar 8 located midway between the circular end openings and is large enough to abut the distributor base opening 14 when an upward thrusting motion is applied.

The purpose of the spacer cup 9 is to prevent the gear 4 from disengaging and shifting from its calibrated position, with respect to the gearing network, in the event that engine reversals occur in the engine. The spacer cup 9 freely rides on top of the gear 4 and rotates in a loose relationship with respect to the distributor base opening 14 and hollow plastic rotor drive shaft 70. Under normal operations, the gear 4 is driven by the gearing network with a counterclockwise rotation so as to have a downward bias applied. However, when engine reversals occur, the gear 4 is impulse driven in a clockwise direction and has a tendency to move upward towards the distributor. The predetermined rotor electrode spark plug terminal registration of the engine is, of course, adversely affected if the gear 4 becomes disengaged from its gearing relationship with the engine. By utilizing the spacer cup 9, any upward thrusting of the gear 4 causes it to immediately be stopped against the lower opening 10, while the collar 8 provides limited upward movement as dictated by the location of the distributor base opening 14. Therefore, the spacer cup 9 prevents any disengagement of the gear 4 with the gearing network. In its present embodiment, the spacer cup 9 is formed from a high strength lightweight thermo-plastic material such as 30% glass filled polyethylene terapthalate sold under the tradename of "RYNITE 530".

The distributor base 16 is shown in FIGS. 1, 3, 4 and 8. The base 16 is also formed of "RYNITE 530" in its present embodiment. The base 16 includes a lower support sleeve 13 with a lower opening 14. The sleeve 13 fits into an aperture 3 on the engine housing 1 and surrounds the outside of the relatively large end 12 of the spacer cup 9. A distributor base to engine hold down mechanism is shown as including a resilient arm 26 molded integral with a circular collar 18. The resilient arm 26 contains a partial socket 28 which opposes a partial socket 29 molded into the collar 18. The two socket portions 28 and 29 are configured to capture and hold a post 30 which is threaded into a pretapped hole 31 at a predetermined position on the engine housing. The post 30 includes a head 33 having a downwardly facing shoulder portion 32 at a predetermined height above the engine. A ramp surface 20 formed in the collar 18 is configured so that, when one inserts the lower support sleeve 13 of the base 16 into the aperture 3 of the engine 1 and rotates the base in a counterclockwise direction, the ramp surface 20 will engage the shoulder 32 and cause a downward force to be applied to the distributor. Such a downward force causes compression sealing of a gasket 11 against the engine housing 1. Further rotation of the base 16 causes interaction between the rigid post 30 and a movable cam surface 24 on the movable end of the resilient arm 26. When the base 16 is turned sufficiently, the socket 28 will mate with the post 30 and cause it to be compressed against the partial socket 29. At that time, the base is locked in a predetermined fixed position and is not thereafter adjustable.

The lower portion of a commutation cavity 35 is formed at the upper end of the base 16. The lower portion of the cavity 35 is formed with a circular floor 37, a surrounding side wall 38, a circular step surface 39 and a concentrically surrounding outer side wall 34.

A common high voltage brass electrode 40 is attached to the circular floor 37. The common electrode 40 has four arcuate shaped conducting surfaces 41, 42, 43 and 44 evenly spaced about a central axis. The electrode 40 is fastened to the distributor base floor 37 by four integrally molded locaters 45, 46, 47 and 48. After the brass electrode 40 is set in place so that the locaters extend through corresponding apertures in the electrode 40, the plastic locaters are permanently deformed to hold the electrode 40 in place.

The common electrode 40 also includes a vertical portion 49 which extends below the base floor 37 and forms the terminal receiving aperture 50 aligned with the high voltage terminal socket 36.

The common electrode 40 further includes a fixed central ring portion 51 which extends upward from the planar portion of the electrode concentric with the central axis. The ring portion 51 contains an outer diameter surface 52 and an inner diameter surface 53. The inner and outer surfaces of the ring portion 51 provide bearing surfaces for the hollow plastic rotor driveshaft 70, subsequently described.

The distributor base 16 further includes several alignment posts 58 which are used to align hollow spark plug terminals which are subsequently described as those forming a lower set of terminals. The alignment posts 58 extend from the step surface 39 in a vertical direction and are aligned with terminal tower openings in the distributor cap 110.

Several compression pads 59 are also located on the step surface 39, immediately adjacent side wall 34. They function to abut the lower edge of the distributor cap and provide a limit with respect to its maximum extension into the commutation cavity 35.

The base 16 further includes resilient arms 60 which extend outwardly and upward to receive and mate with hold-down latches on the cap. Each resilient arm contains an upward facing camming surface 61 which slopes downwardly and away from the base and a downward facing latching surface 62 which also slopes downwardly and away from the base. The two surfaces 61 and 62 intersect at an outer edge 63.

A hollow plastic rotor driveshaft 70 is shown in FIGS. 1, 3, 4 and 7. It is a unitary structure molded from a thermoplastic material, such as Nylon containing approximately 3% silicon. The lower end of the rotor driveshaft 70 contains an hexagonal cross-sectional socket 72 which is configured to mate with the similarly sized hexagonal cross-section driveshaft 6. It has been found that the thermo-plastic material employed for the hollow rotor driveshaft 70 has a tendency to expand, when heated, at a rate that is approximately three times greater than the metallic shaft 6. Without compensation, the size of the socket 72 would normally expand, when heated, so as to be in a loose driving engagement with the driveshaft 6 and cause a rotational shift between the driveshaft 6 and the rotor driveshaft 70. Such a shift would adversely affect registration between the rotor electrode mounted on the rotor driveshaft 70 and spark plug electrodes. Therefore, a compressive spring 74 of coiled steel wire is mounted onto the lower end of the hollow plastic rotor driveshaft 70 so as to surround a portion of the hexagonal socket 72 and prevent that portion of the plastic shaft from excessively expanding, when heated, and becoming larger in cross-section than the hexagonal shaft 6.

The hollow plastic rotor driveshaft 70 is centrally fitted within the distributor base 16 through the aperture formed by the ring portion 51 of the common electrode 40. A suitable composition ring 93 provides an oil vapor barrier between the base and commutation cavity.

The upper end of the hollow plastic rotor driveshaft 70 forms a circular rotor mounting base 71 and contains several resilient tangs 76 which extend downwardly from the top, to provide tension against the inner diameter surface 53 of the ring portion 51 of the common electrode 40. An inner diameter surface 78 on the rotor mounting base 71 is slightly larger than the outer diameter 52 of the ring portion 51 on the brass common electrode 40, within close tolerances. Surfaces 78 and 52 form a bearing that allows the rotor mounting base 71 to rotate with respect to the fixedly mounted electrode 40. A molded ring 79 is formed on the lower surface of the rotor mounting base 71 and extends downwardly therefrom to provide a thrust bearing surface that interacts with the upper surface 56 of the common electrode 40. The combination of the hollow plastic rotor driveshaft 70 with the brass electrode 40 provides a single bearing which prevents downward movement of the hollow driveshaft 70 towards the driveshaft 6 and also prevents lateral or eccentric movement of the rotor mounting base 71 during rotation.

Since the thermo-plastic material used to form the rotor driveshaft 70 has been found to expand, in response to increased temperatures, faster than the brass electrode 40, the inside diameter plastic surface 78 is employed to ride on the outer diameter brass surface 52 and eliminate any possibility of binding therebetween.

The rotor mounting base 71 at the upper end of the hollow rotor driveshaft 70 contains a plurality of self-tapping screw sockets 73 which extend upwardly therefrom. An alignment tab 75 is located adjacent each socket and used to position a rotor locking mechanism, subsequently described.

The underside of the rotor mounting base 71 includes several vanes 77 which extend radially outward from the thrust bearing ring 79. These vanes collectively cause turbulence of the air/ozone gas mixture that accumulates within the commutation cavity 35. The turbulence causes the accumulated ozone to be vented out of the cavity 35 through a serpentine air channel defined between the mated distributor base 16 and distributor cap 110.

A dynamically balanced circular rotor element 80 is shown in FIGS. 1, 3, 8, 9A and 9B and is fitted onto the rotor mounting plate 71 so as to rotate therewith inside the commutation cavity 35. In the present embodiment, the rotor element 80 is also formed from a thermo-plastic material, such as "RYNITE 530". The rotor 80 contains a central aperture 81 which is concentric with and encircles the upper extension 82 of the rotor mounting plate 71. The rotor 80 also includes an outer ring 83. The rotor 80 is shown in detail in FIGS. **1, 3, 7, 8, 9*a*** and 9b. The rotor 80 contains oppositely located commutation conductors 84 and 86. The commutation conductors 84 and 86 define identical arc angles and respectively travel in circular paths during rotation of the rotor. The arcuate shaped edge of the commutation conductor 84 travels in a circular path which is at an upper level with respect to the circular path defined by the travel of the arcuate shaped edge of the commutation conductor 86. It is further noted that the distance from the central axis of rotation, of the rotor 80, to the outer edge of the arcuate shaped commutation conductor 84 is less than the distance from the central axis to the outer edge of the arcuate shaped commutation conductor 86. Therefore, the two circular paths of travel are different in diameter. The upper commutation conductor 84 is configured so as to have a high voltage pick-up portion 85 which extends through mounting base 71 and travels in a circle directly adjacent the horizontally disposed arcuate shaped conducting surfaces 41, 42, 43 and 44 of the common electrode 40. The arcuate shaped lower commutation conductor 86 also has a pick-up portion 87 which extends below the rotor mounting base 71 and travels in the same circle as pick up portion 85 to communicate with the arcuate surfaces of the conductor 40. The pick-up portion 87 is offset by approximately 45° with respect to the center of conductor 86 so that when the pick-up portion 85 is in arc-gap conduction registration with an arcuate portion of conductor 40, the pick up portion 87 is in a non-conducting region between arcuate surfaces of the conductor 40, and vice versa.

The rotor 80 is held in place on the rotor mounting plate 71 with two identical locking assemblies. Two arcuate apertures 88 are defined in the rotor 80 in diametrically opposite quadrants thereof. The apertures 88, each have an inner arcuate shaped side wall 89 and an outer arcuate shaped side wall 90. The inner and outer arcuate shaped side walls are slightly tapered towards each other, from top to bottom, the outer side wall 90 contains generally vertical serrations over an extensive area. A rotor locking wedge 91, for each aperture 88, is configured to fit over the socket 73 which extends into the aperture 88 from the rotor mounting base 71. Each wedge 91 has one surface 94 which extends part way down the wedge and is serrated and tapered to match and engage the serrated surface 90. The locking wedges 91 each have a central aperture 95 and a lower opening 96. The lower opening 96 is configured to surround the socket 73 when the wedge 91 is lowered into place so that surfaces 94 and 90 are mated. A screw 97 has an upper shank portion 98, which has the same cross-sectional dimension as the central aperture 95, and a lower threaded portion 99, which threads into the socket 73. When the screw 97 is tightly threaded into the socket 73, the locking wedge 91 is clamped into place with serrated surface 94 tightly engaged against and mated with serrated side wall 90 on the rotor 80. When relative adjustment is desired of the rotor 80 with respect to the rotor mounting plate 71, and the distributor base 16, or for initial registration of the rotor conductors with a particular spark plug terminal, the screws 97 are turned counterclockwise so as to be partially threaded out of the socket 73. As the screw 97 is assembled to the wedge element 91, it is held by friction to the shank 98 and therefore holds up the wedge element 91 to a point where the surfaces 94 and 90 are not mated. At that point, the rotor element 80 may be freely turned and adjusted so that it is in proper registration.

Each wedge 91 also includes two modified wing extensions 101 and 102 which are tapered to match the arcuate tapered surface 89 of the rotor, when locking wedge 91 is secured in place by the screw 97. The modified arms 101 and 102 surround the tab 75 and provide for a linear guide way which prevents the wedge from turning in place as the screw is threaded into and out of the socket 73.

The rotor 80 further includes an integrally molded plastic spring element 103 which is joined to the internal circular surface of central aperture 81 at points 104 and 105. The integral spring 103 includes a biasing button 106 which applies upward pressure to the distributor cap 110 and biases the circular thrust bearing ring 79 against surface 56 of common electrode 40. The upper ring edge 107 of the central aperture 81 provides protection for the spring 103 by extending above it, but below the top of biasing button 106. The ring edge 107 will contact a matching ring 108 on the cap 110 whenever the cap is depressed sufficiently to overcome the spring bias.

A distributor cap 110 is shown in detail in FIGS. 1, 2, 3 and 7 and is also formed from "RYNITE 530" in its present embodiment. The distributor cap 110 is formed of a molded thermo-plastic material and is configured to mate with the base 16 to define the commutation cavity 35. The distributor cap 110 has a V-shaped groove 112 defined in its outer circumference to accept the protruding circular side wall 34 of the base 16. When properly latched in place, the biasing provided by the integral spring 103 and its associated biasing button 106 causes the V-groove 112 to remain open and define a serpentine channel by which the impelled air/ozone can be circulated and expelled from the inside of the distributor. The pads 59 maintain a minimal separation between the cap and the base so that even if the cap is forced against the base during operation, the serpentine channel will remain open to allow for the escape of any accumulated ozone gas from within the cavity 35.

In order to provide a single mating configuration, the base contains a key 15 which is on the outer surface of the side wall 34 while the cap 110 contains a keyway 115 on the inner surface of the V-groove 112.

The distributor cap 110 contains a first set of towers 114 which are evenly distributed on a circle concentric with the shape of the distributor cap near the outer upper edge thereof. Each tower in the set 114 contains a narrow passage 116 which is axially aligned with posts 58 extending from the step surface 39 in the base 16.

The distributor cap 110 also contains a second set of towers 118 evenly distributed with respect to each other and the first set of towers, on a concentric circle having a diameter smaller than that for locating towers 114. Each tower in the set 118 contains a relatively wide passage 120, as compared to the passages 116, and each passage 120 is aligned with an elevated stop post 122 which is molded internal to the cap 110 and extends radially from the outer side wall towards the commutation cavity 35. The tower sets 114 and 118 provide for the insertion of spark plug wire terminal connectors 121 and 131, which are respectively commutated by the lower commutation conductor 86 and upper commutation conductor 84.

As can be seen in FIG. 3, the tower sets 114 contain a narrowed down neck portion 113 and an insulating shroud 117. The shroud 117 provides a direct air path insulating gap between the upper blade 84 and the lower set of spark plug terminal connectors 121 inserted in the tower set 114 to prevent misfiring of a lower terminal connector 121 by the upper commutation rotor blade 84.

Spark plug terminal connectors 121 define the lower set of terminals for commutation by the lower rotor blade 86. The spark plug wire terminal connectors which define the upper set, commutated by the upper rotor blade 84, are appropriately shorter than terminal connectors 121 and are designated as 131. The lower portions of terminal connectors 121 and 131 are shown in greater detail in FIG. 6. They are both hollow and contain externally located detents 123 extending outward from the surface on resilient tabs 124. The resilient tabs 124 extend along the curve surface and are formed by an H-shaped cutout 127 wherein the cross bar of the H cutout extends parallel to the length of the terminal connector. Each spark plug wire terminal connector contains a resilient boot 125 formed to cover the junction between the terminal connector and the spark plug wire 126 and to provide a moisture tight seal for the towers on the distributor cap 110 and the terminal connectors.

In order to prevent the shorter terminal conectors 131 from being plugged into towers of set 114, terminal connectors 131 include an enlargement 135 above the detents 123. The passages 116 of the tower set 114 contain longitudinal ribs 119 to produce a reduced sized aperture, with respect to the passages 120 of the set 118, and with respect to the diameter of the enlargement 135. Therefore, if one were to attempt to insert a terminal connector 131 into a tower 114, the lower edge of the rubber boot 125 would just barely extend pass the upper edge of the tower and it would be clear that the terminal connector 131 was not being properly engaged in the distributor cap 110.

In order to prevent the wrongful insertion of the longer terminal connectors 121 into the tower set 118, alignment stops 122 are provided as integrally molded portions of the distributor cap 110 and prevent full insertion of the elongated spark plug terminal connectors 121. Of course the normal function of each alignment stop 122 is to positionally hold the bottom edge of an inserted terminal connector 131 in proper position for commutation by the upper rotor blade 84, elevated for non-commutation by the lower rotor blade 86.

The hold down latching mechanism between the distributor cap 110 and the base 16 is provided by an interaction between integrally molded extensions 140 of the cap 110. The extensions 140 each include a lower camming surface 142 which faces downward towards the base and slopes away from the cap 110. A rigid latching surface 143 is located directly above the camming surface 142, faces in a generally upward direction and slopes downwardly away from the cap 110. Due to this configuration, when the cap 110 is mated with the base 16, camming surfaces 61 and 142 initially abut each other. As downward compression forces are applied between the distributor cap 110 and the base 16, the movable camming surface 61 slides inward, with respect to rigid camming surface 142, towards the cap 110 and bends the resilient pre-stressed arm 60 inward. When the cap 110 is compressed sufficiently downward, the resilient arm causes the downward sloping latching surface 62 on the resilient arm 60 to spring outward and over the downward sloping rigid latching surface 143 on the cap 110. When compression forces are released, the internal biasing spring 103 causes the biasing button 106 to move the cap 110 upward until the latching surfaces 62 and 143 are in contact to lock the cap 110 in a spaced relationship with respect to base 16.

As mentioned earlier, the high voltage common electrode 40 contains an aperture 50, aligned with a high voltage terminal passage 36. A hollow high voltage connecting terminal 150 is connected to a coil wire 151 and is similar in construction to the spark plug terminals described above. However, the terminal 150 contains a tapered nose portion 152 and detents 153. Detents 153 are spring biased. The nose portion is provided with a slot 155 which extends parallel to the length of terminal 150 and is combined with a transverse cross slot 156. A rubber boot 158 is also provided as a moisture seal to prevent oxidation of the terminal and the connection.

It will be apparent that many modifications and variations may be effected without departing from the scope of the novel concept of this invention. Therefore, it is intended by the appended claims to cover all such modifications and variations that fall within the true spirit and scope of the invention.

What is claimed is:

1. An ignition distributor rotor alignment and lock-down assembly comprising:

a distributor housing adapted for non-rotational mounting on an internal combustion engine and defining a rotor shaft housing along a central axis and a commutation cavity at one end of said shaft housing;

a rotor shaft mounted for rotation in said shaft housing and adapted for rotational driving connection to said engine about said central axis;

a commutation rotor mounted on said rotor shaft for rotation therewith;

means for mounting said commutation rotor on said rotor shaft in a selected angular disposition about said axis with respect to a predetermined point on said distributor housing and a corresponding timing position of said engine, wherein said rotor is circularly configured with at least one arcuate aperture having outer and inner arcuate side walls, one of which is tapered with respect to said central axis and said mounting means includes a correspondingly tapered wedge element configured to fit in a plurality of locations within an associated arcuate aperture and means for attaching said wedge element to said rotor shaft.

2. An assembly as in claim 1, wherein said wedge element attaching means selectively positions said wedge element in a locking engagement position and an unlocked non-engagement position with respect to said rotor.

3. An assembly as in claim 2, wherein said rotor shaft includes a mounting plate at one end of said shaft within said commutation cavity and said wedge element is attached to said plate.

4. An assembly as in claim 3, wherein said rotor contains a plurality of arcuate apertures and said mounting means includes a correspondingly tapered wedge element associated with each aperture, attached to said mounting plate by said attaching means.

5. An assembly as in claim 4, wherein each of said wedge elements includes a central aperture parallel to said central axis, said mounting plate contains a threaded socket aligned with said central wedge aperture and said attaching means is a threaded screw which threads into said socket through said central wedge aperture.

6. An assembly as in claim 3, wherein said wedge element includes a central aperture parallel to said central axis, said mounting plate contains a threaded socket aligned with said central wedge aperture and said attaching means is a threaded screw which threads into said socket through said central wedge aperture.

7. An assembly as in claim 3, wherein said at least one of said arcuate side walls of said at least one aperture contains a plurality of serrations.

8. An assembly as in claim 7, wherein said wedge element is serrated to mate with serrations on said arcuate aperture side wall when said wedge element is in a locking engagement position.

9. An assembly as in claim 1, wherein at least one of said outer and inner arcuate side walls is serrated;

said wedge element has a tapered surface serrated to match a plurality of locations within said arcuate aperture.

10. An assembly as in claim 6, wherein said mounting plate contains means for preventing wedge rotation as said wedge is selectively positioned.

11. An assembly as in claim 10, wherein said rotation preventing means includes a tab extending from said mounting plate parallel to said threaded socket and said wedge element contains a guideway adjacent said central aperture for receiving said tab.

12. An assembly as in claim 11, wherein at least one of said arcuate side walls of said at least one aperture contains a plurality of serrations and said wedge element has a serrated surface to mate with serrations on said arcuate aperture side wall when said wedge element is in a locking engagement position.

13. An assembly as in claim 12, wherein said guideway is formed by a pair of wing extensions from said central aperture in a direction opposite said serrated surface of said wedge.

* * * * *